US006811063B2

(12) United States Patent
Hachtel et al.

(10) Patent No.: US 6,811,063 B2
(45) Date of Patent: Nov. 2, 2004

(54) CLAMPING ELEMENT

(76) Inventors: Friedrich Hachtel, Ziegelstrasse 132, 73431 Aalen (DE); Steffen Hachtel, Roentgenstrasse 16, 71522 Backnang (DE)

( * ) Notice: Subject to any disclaimer, the term of this patent is extended or adjusted under 35 U.S.C. 154(b) by 0 days.

(21) Appl. No.: 09/497,378

(22) Filed: Feb. 2, 2000

(65) Prior Publication Data

US 2002/0190089 A1 Dec. 19, 2002

(30) Foreign Application Priority Data

Feb. 2, 1999 (DE) ..... 299 01 640 U
Jul. 6, 1999 (DE) ..... 299 11 695 U

(51) Int. Cl.[7] ..... A41D 27/22
(52) U.S. Cl. ..... 223/85
(58) Field of Search ..... 223/85, 93, 91, 223/96

(56) References Cited

U.S. PATENT DOCUMENTS 2,998,173 A 8/1961 Lutz
5,016,514 A * 5/1991 Kaufman ..... 84/318
6,286,734 B1 * 9/2001 Schneider ..... 223/93

FOREIGN PATENT DOCUMENTS

DE 197 35 907 A 6/1998
GB 2 273 867 A 7/1994

* cited by examiner

*Primary Examiner*—John J. Calvert
*Assistant Examiner*—James G Smith
(74) *Attorney, Agent, or Firm*—Michael J. Striker

(57) ABSTRACT

A clamping element (10, 21) for fixing an article of clothing, especially a pair of pants, to a transverse support (27), which connects the ends of a clothes hanger (20) and has a middle reinforced region (15, 26) and two outer leaf spring elements (11, 12, 28, 29), which is made entirely of plastic.

9 Claims, 1 Drawing Sheet

CLAMPING ELEMENT

BACKGROUND OF THE INVENTION

The invention relates to a clamping element for fixing an article of clothing, especially a pair of pants, to a transverse support, which connects the ends of a clothes hanger and has a middle reinforced region and two outer leaf spring elements.

Clamping elements of this type have previously been made as a composite part, comprising a middle plastic handle and a steel leaf spring element. Making such a composite part is relatively complicated, since the steel leaf springs have to be prefabricated and then mounted on separately manufactured plastic components or placed in the injection molding tool so they can be spray-coated. The prefabrication and mounting or placement of the leaf spring elements represent an additional task to the injection molding and thus also entail additional costs.

The object of the invention is to create a clamping element in which the prefabrication and placement of a leaf spring element is the injection molding tool as in the prior art can be dispensed with, as can the alternative mounting of the leaf spring with plastic elements.

The invention attains this stated object with a clamping element for fixing an article of clothing, especially a pair of pants, to a transverse support, which clamping element connects the ends of a clothes hanger and has a middle reinforced region and two outer leaf spring elements, and this clamping element is made entirely of plastic. Thus the prefabrication of the leaf spring elements and the prior placement of the leaf spring elements in the injection molding tool or the mounting on plastic elements are thus automatically dispensed, and as a result the production costs can be reduced considerably, especially with a view to large-scale mass production.

The leaf spring elements can have a thickness that varies over their length. As a result, the thickness can be adapted to the magnitude of the stresses acting in the component, resulting in the least possible elongation of the leaf spring elements. Thus any possible overload from excessive tensions or elongation that can lead to relaxation or creep of the leaf spring element is prevented.

To enable assuring optimal spring properties of the leaf spring elements, the leaf spring elements can protrude into the reinforced middle region. As a result, the recoil function of the clamping element can reliably be assured.

The leaf spring elements can have a curvature, so that at the connecting points to the clothes hanger they have an angle of inclination of preferably 1–35 relative to the horizontal. As a result of this curvature, the spring behavior and the recoil of the leaf spring elements as well as the contact pressure on the article of clothing fastened in them are improved.

SUMMARY OF THE INVENTION

So that the clamping element will snap open and closed readily when the article of clothing is fastened in it or when the clamping element is opened, on both ends it can have a respective joint for articulated connection to the clothes hanger.

Advantageously, the clamping element can be made from plastic, preferably POM, polycarbonate, or impact resistance modified polystyrene.

To attain higher clamping forces and an improved recoil function, a glass fiber reinforced plastic, such as POM-GF can also be used.

If the clamping element is made of an amorphous plastic, such as polycarbonate, then the leaf spring elements in particular have less tendency to relax.

It is also possible to make the clamping element in a single operation, without separate assembly steps.

For the sake of simple production, the reinforced middle region and the leaf spring elements can be embodied as a one-piece injection-molded part.

BRIEF DESCRIPTION OF THE DRAWINGS

Various exemplary embodiments of clamping elements according to the invention will be described in further detail below in conjunction with the accompanying drawing.

Specifically.

DESCRIPTION OF THE PREFERRED EMBODIMENTS

Figure 1:
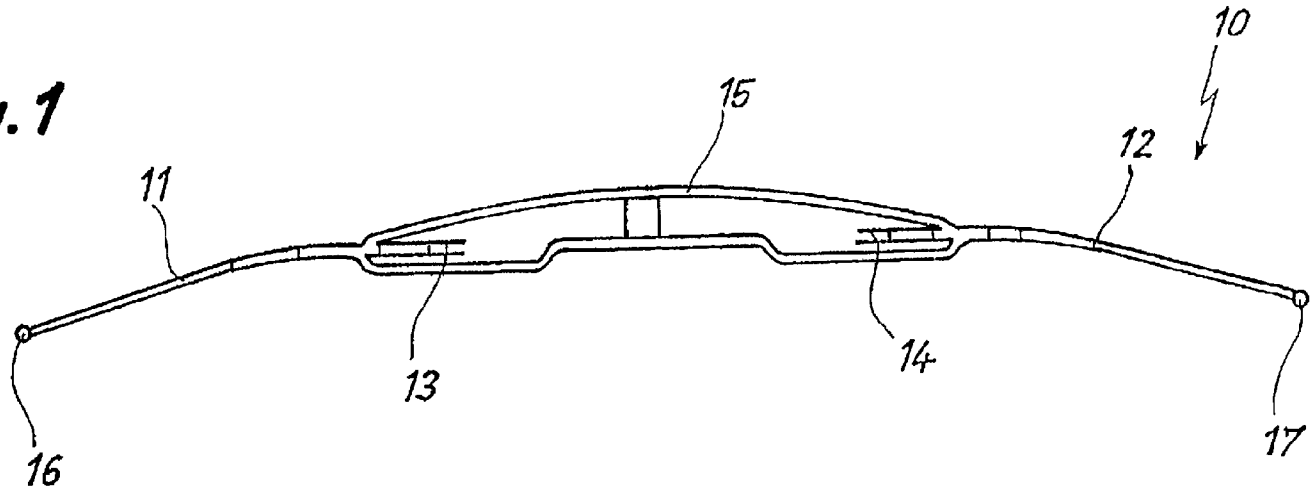
FIG. 1 shows a side view on a clamping element.

FIG. 1 shows a clamping element 10, made entirely of plastic, which has two leaf spring elements 11 and 12. The leaf spring elements 11 and 12 protrude with the portions 13 and 14 into a reinforced middle region 15. As a result of the reinforced middle region 15 and the elements 13 and 14 protruding into it, the leaf spring elements 11 and 12 are provided with optimal snap properties, which are helpful in fastening an article of clothing or in opening the clamping element 10. The leaf spring elements 11 and 12 have a thickness that varies over their length. As a result, a uniform distribution of tension and elongation over the length of the leaf spring elements 11 and 12 is attained. Relaxation or creep of the leaf spring elements 11 and 12 can thus be averted. The leaf spring elements 11 and 12, together with their portions 13 and 14 and the reinforced middle region 15, can advantageously be embodied as a one-piece plastic injection-molded part. A joint element 16 and 17 for articulated support on a clothes hanger, not shown in further detail, is mounted on each of the ends of the leaf spring elements 11 and 12.

Figure 2:
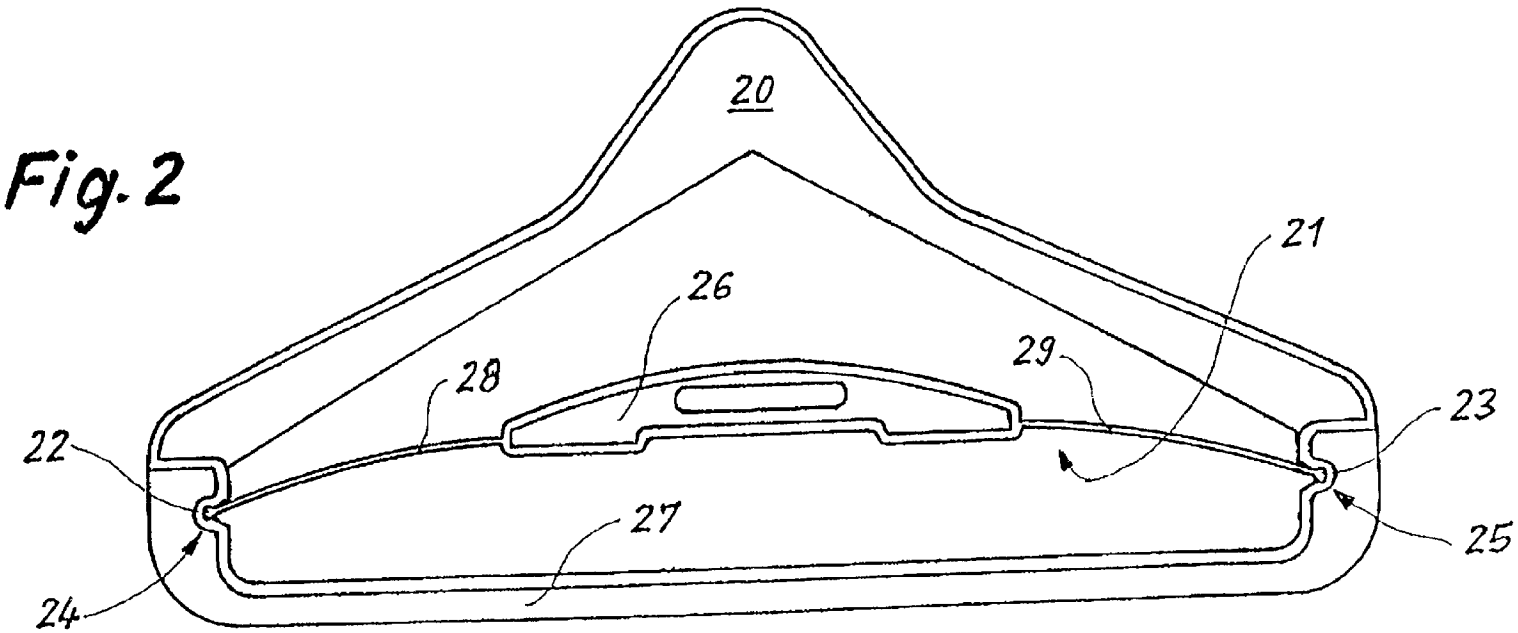
FIG. 2 is a side view on a second clamping element, mounted in a clothes hanger.

FIG. 2 shows a clamping element 21 mounted in a clothes hanger 20 and having two outer leaf spring elements 28, 29 and a reinforced middle region 26 of plastic. On the ends of the leaf spring elements, joint elements 22 and 23 are placed in joint receptacles 24 and 25 on the clothes hanger 20. For fastening an article of clothing, not shown here, the clamping element 21 is pressed downward, whereupon a reinforced middle region 26 presses the article of clothing against a transverse support 27 of the clothes hanger 20 and thus holds it firmly. The clamping element 21 can be released from its clamping position again by pulling on the middle region 26 or pressing on one of the leaf spring elements 28, 29.

What is claimed is:

1. A clamping element (10, 21) for fixing an article of clothing, especially a pair of pants, to a transverse support (27), which connects the ends of a clothes hanger (20) and has a middle reinforced region (15, 26) and two outer leaf spring elements (11, 12, 28, 29), characterized in that it is made entirely of plastic, and the leaf spring elements (11, 12, 28, 29) have a thickness that varies over their length to adapt it to a magnitude of stresses acting on the clamping element so as to provide a least possible elongation of the leaf spring elements and therefore prevent relaxation or creep of the leaf spring elements.

2. The clamping element (10, 21) of claim 1, characterized in that the leaf spring elements (11, 12, 28, 29) protrude into the reinforced middle region (15, 26).

3. The clamping element (10, 21) of claim 1, characterized in that the leaf spring elements (11, 12, 28, 29) have a curvature, so that at the connecting points (16, 17, 22, 23) to the clothes hanger (20) they have an angle of inclination of preferably 1°–35° relative to the horizontal.

4. The clamping element (10, 21) of claim 1, characterized in that on both ends it has a respective joint element (16, 17, 22, 23) for articulated connection to the clothes hanger (20).

5. The clamping element (10, 21) of claim 1, characterized in that it is made from plastic, preferably POM, polycarbonate, or impact resistance modified polystyrene.

6. The clamping element (10, 21) of claim 1, characterized in that it is made of a glass fiber reinforced plastic, such as POM-GF.

7. The clamping element (10, 21) of claim 1, characterized in that it is made of an amorphous plastic.

8. The clamping element (10, 21) of claim 1, characterized in that it is made in a single operation.

9. The clamping element (10, 21) of claim 1, characterized in that the reinforced middle region (15, 26) and the leaf spring elements (11, 12) are embodied as a one-piece injection-molded part.

* * * * *